US009315947B2

(12) United States Patent
Cox et al.

(10) Patent No.: US 9,315,947 B2
(45) Date of Patent: Apr. 19, 2016

(54) RAILWAY RAIL FASTENING CLIP AND INSULATOR

(75) Inventors: Stephen John Cox, Richmond (GB); Christopher Gardner, Worksop (GB); Frank H. Coats, West Deptford, NJ (US); Louis M. Notarianni, Hatboro, PA (US)

(73) Assignee: PANDROL LIMITED, Addlestone, Surrey (GB)

( * ) Notice: Subject to any disclaimer, the term of this patent is extended or adjusted under 35 U.S.C. 154(b) by 92 days.

(21) Appl. No.: 13/979,412

(22) PCT Filed: Jan. 24, 2012

(86) PCT No.: PCT/GB2012/050138

§ 371 (c)(1),
(2), (4) Date: Aug. 7, 2013

(87) PCT Pub. No.: WO2012/104600

PCT Pub. Date: Aug. 9, 2012

(65) Prior Publication Data

US 2013/0306747 A1 Nov. 21, 2013

(30) Foreign Application Priority Data

Feb. 1, 2011 (GB) ..... 1101720.9

(51) Int. Cl.
*E01B 9/28* (2006.01)
*E01B 9/30* (2006.01)

(52) U.S. Cl.
CPC .. *E01B 9/30* (2013.01); *E01B 9/306* (2013.01)

(58) Field of Classification Search
CPC ..... E01B 9/00; E01B 9/02; E01B 9/28; E01B 9/30; E01B 9/303; E01B 9/306; E01B 9/60
USPC ..... 238/310, 315, 338, 343, 351
See application file for complete search history.

(56) References Cited

U.S. PATENT DOCUMENTS 1,890,636 A 12/1932 Young
2,954,169 A 9/1960 Rigby et al.

(Continued)

FOREIGN PATENT DOCUMENTS

AU 630250 5/1991
CH 444206 9/1967

(Continued)

OTHER PUBLICATIONS

International Search Report for WO application PCT/GB2012/050138, dated May 10, 2012.

(Continued)

*Primary Examiner* — R. J. McCarry, Jr.
(74) *Attorney, Agent, or Firm* — Husch Blackwell LLP

(57) ABSTRACT

In a railway rail fastening clip 1 for fastening a railway rail to an underlying rail foundation, which clip 1 is formed of an elongate plate shaped such that a central region 11 of the plate has in profile the form of a letter C, a first end region of the plate extending from one side of the central region 11 of the plate to form a substantially planar base portion 12 of the clip for engaging a rail fastening anchoring device secured to the rail foundation and a second end region of the plate extending from the opposite side of the central region 11 of the plate to form a toe portion 13 of the clip for bearing on a foot of the railway rail, such that in profile the second end region extends further than the first end region, the toe portion of the clip is provided with a throughhole 14 which is arranged such that, when the clip is in its operative configuration, part or all of the throughhole 14 lies above the foot of the rail, the throughhole being configured to receive a corresponding spigot 25 of a toe insulator 2 for electrically insulating the clip from the rail whereby the insulator can be retained on the toe portion of the clip.

24 Claims, 10 Drawing Sheets

(56) References Cited

U.S. PATENT DOCUMENTS

| | | | | |
|---|---|---|---|---|
| 3,309,023 | A | 3/1967 | Burwell | |
| 4,327,865 | A * | 5/1982 | Greene | 238/310 |
| 4,479,607 | A | 10/1984 | Okumura et al. | |
| 4,819,870 | A | 4/1989 | Clark et al. | |
| 5,520,330 | A | 5/1996 | Brown et al. | |
| 5,865,370 | A | 2/1999 | Sonneville et al. | |
| 6,305,613 | B1 | 10/2001 | Igwemezie | |
| 2002/0011526 | A1 | 1/2002 | Igwemezie | |
| 2004/0056108 | A1 * | 3/2004 | Marshall et al. | 238/251 |

FOREIGN PATENT DOCUMENTS

| | | | |
|---|---|---|---|
| EP | 0 027 838 | A1 | 5/1981 |
| EP | 0 677127 | | 10/1995 |
| GB | 696418 | | 9/1953 |
| GB | 818998 | | 8/1959 |
| GB | 1076718 | | 7/1967 |
| GB | 1 573 247 | | 8/1980 |
| GB | 2 115 464 | A | 9/1983 |
| GB | 2 116 612 | A | 9/1983 |
| GB | 2 261 241 | A | 5/1993 |
| GB | 2 269 198 | A | 2/1994 |
| JP | 59-150801 | | 8/1984 |
| JP | 6-322703 | | 11/1994 |
| JP | 2007-239208 | | 9/2007 |
| WO | WO 96/23107 | A1 | 8/1996 |
| WO | WO 02/02873 | A1 | 1/2002 |
| WO | WO 02/31264 | A1 | 4/2002 |
| WO | WO 2010/116118 | A2 | 10/2010 |
| WO | WO 2012/104600 | A1 | 8/2012 |

OTHER PUBLICATIONS

Search Report for GB application 1101720.9, dated May 5, 2011.
Further Search Report for GB application 1101720.9, dated Jul. 28, 2011.

* cited by examiner

PRIOR ART

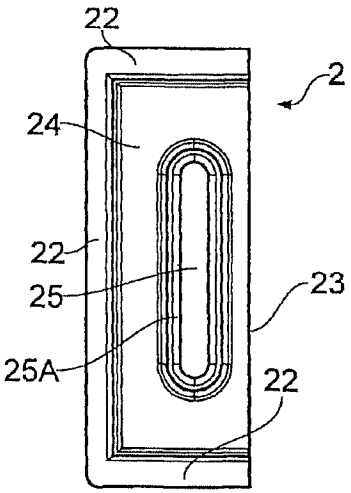
FIG. 5A
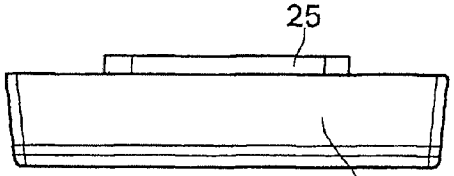
FIG. 5B
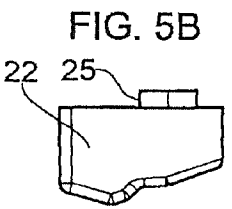
FIG. 5C
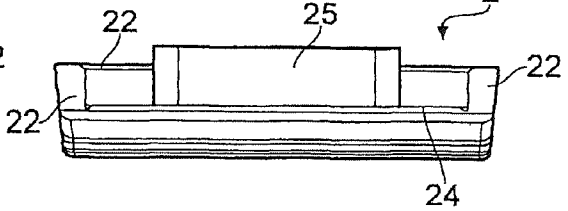
FIG. 5D
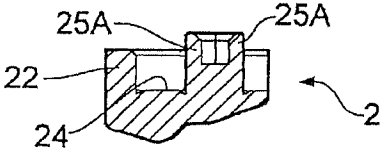
FIG. 5E
FIG. 5F

RAILWAY RAIL FASTENING CLIP AND INSULATOR

FIELD

The present invention relates to a railway rail fastening clip and insulator.

BACKGROUND

As shown in FIGS. 1A, 1B and 1C of the accompanying drawings. WO02/31264A (GB2384020B/US6923381B) discloses a railway rail fastening clip 3 for fastening a railway rail to an underlying rail foundation. The clip 3 is formed of an elongate plate shaped such that a central region 31 of the plate has in profile the form of a letter C, a first end region of the plate extending from one side of the central region 31 of the plate to form a base portion 32 of the clip 3 for engaging a rail fastening anchoring device secured to the rail foundation and a second end region of the plate extending from the opposite side of the central region 31 of the plate to form a toe portion 33 of the clip 3 for bearing on the railway rail, the toe portion 33 extending further than the base portion 32. The toe portion 33 of the clip 3 is bent so as to have first and second main parts 33A, 33B, the first main part 33A extending a different angle to the second main part 33B. The toe portion 33 is birfurcated, each bifurcated part of the toe portion 33 being shaped to provide insulator retaining means 34A, 34B for retaining thereon individual toe insulators (not shown) for electrically insulating the clip 3 from the rail. The base portion 32 of the clip 3 has an end face 36 connected to an inner face 32A of the base portion 32 by a slanted face 37, angled at approximately 45° with respect to both the inner face 32A and the end face 36, which acts as a lead-in chamfer when the base portion 33 of the clip 3 is being driven into the anchoring device. On the inner face of the base portion 32, adjacent to the chamfer 37, is a detent 35.

SUMMARY

According to an embodiment of the present invention there is provided a railway rail fastening clip for fastening a railway rail to an underlying rail foundation, which clip is formed of an elongate plate shaped such that a central region of the plate has in profile the form of a letter C, a first end region of the plate extending from one side of the central region of the plate to form a substantially planar base portion of the clip for engaging a rail fastening anchoring device secured to the rail foundation and a second end region of the plate extending from the opposite side of the central region of the plate to form a toe portion of the clip for bearing on a foot of the railway rail, such that in profile the second end region extends further than the first end region, wherein the toe portion of the clip is provided with a throughhole which is arranged such that, when the clip is in its operative configuration, part or all of the throughhole lies above the foot of the rail, the throughhole being configured to receive a corresponding portion of a toe insulator for electrically insulating the clip from the rail whereby the insulator can be retained on the toe portion of the clip. The throughhole may be made by cold-punching through the plate.

Through its design a clip embodying the present invention may be easier to manufacture so as to have a consistent geometry, since the throughhole can be stamped into the plate before the plate is heated and processed to provide the remaining features of the clip, such as the bends in the plate and a lead-in chamfer on the free end of the second end region of the plate, and thus the operation of forming the throughhole and the operation of providing the remaining features of the clip can have their own respective datum settings.

The throughhole may comprise an elongate slot. The slot may have an approximately rectangular periphery, having substantially straight long sides and rounded short sides.

Although the clip 3 can be installed simply by pushing the back of the clip 3, it cannot be removed simply by pushing at the front of the clip 3, as attempting to do so causes the clip 3 to bind itself ever more tightly into the anchoring device (shoulder). In particular, applying a lateral force to the toe portion of a magnitude which would seem to be sufficient to extract the clip from the shoulder, actually causes the clip to start opening out and roll about the 'heel' contact between the clip and the shoulder. This tends to increase the upward vertical force between the shoulder and the other end of the clip, so locking it ever more tightly into position. It is therefore effectively impossible to pull the clip out by the toe portion, and certainly impossible to do this with the sort of loads that can be applied with hand tools or small machines. Even if much larger forces were applied with larger machines, and the clip were to be removed in this way, the clip and toe insulators would end up being permanently distorted. Consequently, the clip 3 has to be pulled out by pins inserted just in front of the central portion 31 (rear arch). This makes hand tools slower to use and more cumbersome than desirable, and machines more so. Accordingly, it is desirable to provide a railway rail fastening clip which can be extracted more easily from an anchoring device.

An aspect ratio H/L for a clip embodying the present invention may be ≤0.6, H being the height of the clip in profile defined as the maximum extent of the clip above a plane containing an outer surface of the base portion and L being the length of the clip in profile defined as the maximum extent of the clip in a direction parallel to the plane.

A ratio H/h for a clip embodying the present invention may be ≤6.00, H being the maximum extent of the clip above a plane containing an outer surface of the base portion and h being the minimum distance between the plane and a point on the second end region of the clip which is closest to the plane.

In contrast to the prior art clip described above, a clip having an aspect ratio H/L≤0.6 and/or a ratio H/h≤6.00 can, owing to its side-on geometry, be extracted from a shoulder much more easily by pulling on the front of the clip, despite the fact that the contact points between the clip and the shoulder, and the relative positions of these compared to the toe, are all substantially the same as in the prior art clip.

This improvement is thought to result from an increased stiffness of the lower part of the clip which is such that, as the force applied at the toe increases, the lower clip transmits enough of the lateral extraction force component from the toe to the other end of the bar, where the clip is located and held into the shoulder, that it is able to disengage before the vertical force builds up to an extent that locks it even more tightly in place.

It has been found that for such a clip strains on installation are the same or slightly lower than for the prior art clip, and the load-deflection characteristic is very similar to that of the prior art clip. A clip having the specified ratio(s) will fit into the existing shoulder. Although a new tool can be designed to extract the clip more easily, the new clip is backwardly compatible in that it can be extracted using a slightly modified version of the existing tool used to pull the prior art clip out by its rear arch.

In a preferred embodiment of the present invention the clip is provided with a rail clip insulator for electrically insulating the clip from a railway rail, the insulator comprising: a base;

walls extending upwards from the base around some of the periphery of the base so as to leave an opening along part of the periphery, the base and the walls together defining an open-topped recess for receiving the toe portion of the clip; and a spigot extending upwards from the base for retaining the toe portion of the clip within the recess, wherein the said insulator is arranged on a lower, load bearing surface of the toe portion of the said clip such that the spigot of the insulator extends through the said throughhole of the said toe portion.

In contrast to the prior art clip 3, where each toe part is provided with its own insulator cap which is attached to relatively small features punched in the end of each toe part, the toe portion of a clip embodying the present invention has a throughhole which can engage the spigot of an insulator. The loads that are applied to the toe when the clip is driven on to and off the rail are therefore applied through the spigot that passes through the clip toe, which provides a more secure connection when the clip is being extracted than the prior art arrangement.

The spigot of the insulator may be made of deformable material. The spigot may be a hollow member. The spigot may comprise walls defining the outline of the spigot. The spigot may be open at its top and/or its bottom. The spigot may be located substantially centrally on the base of the insulator. The spigot may have an approximately rectangular outline, having substantially straight long sides and rounded short sides.

In certain circumstances, for example in order to retain the insulator more securely on the clip toe, a top end of the spigot, which extends upwards beyond the throughhole, may be shaped such it extends over part of an upper surface of the toe portion adjacent to the throughhole. The shaping of the toe end of the spigot may be applied either during manufacture of the insulator or after insertion of the spigot into the throughhole, for example through the deformation of the top end of the spigot. Alternatively, after insertion of the spigot into the throughhole, the top end of the spigot may be provided with a cap member which extends over part of the upper surface of the toe portion adjacent to the throughhole.

BRIEF DESCRIPTION OF THE DRAWINGS

Reference will now be made, by way of example, to the accompanying drawings, in which:

FIGS. 5A, 5B, 5C, 5D, 5E and 5F show respective perspective, plan, front, side, rear and cross-sectional views of a rail clip insulator for use with a clip embodying the present invention, FIG. 5F showing a cross-section of the insulator taken on line V-V in FIG. 5B;

FIG. 7D is a cross-section on line D-D in FIG. 7C.

DETAILED DESCRIPTION

Figure 1A:
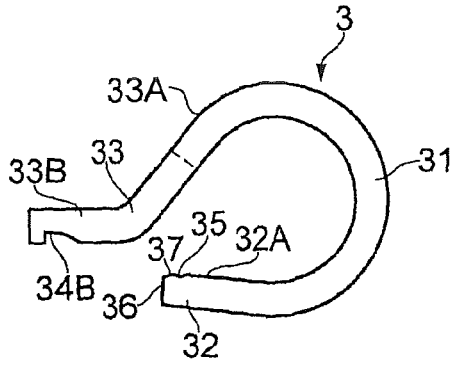
FIGS. 1A, 1B and 1C (described above) show respective side, front and plan views of a prior art railway rail fastening clip.
Figure 1B:
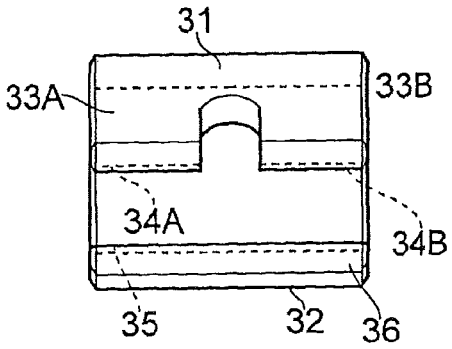
FIG. 1B PRIOR ART
Figure 1C:
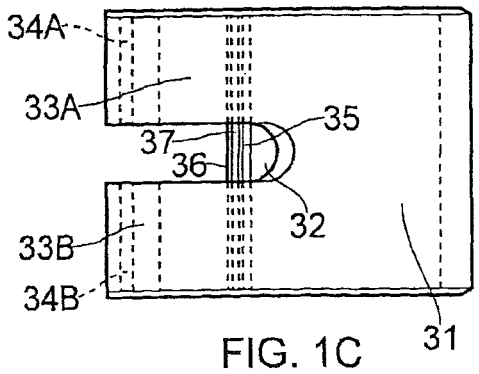
FIG. 1C PRIOR ART
Figure 2C:
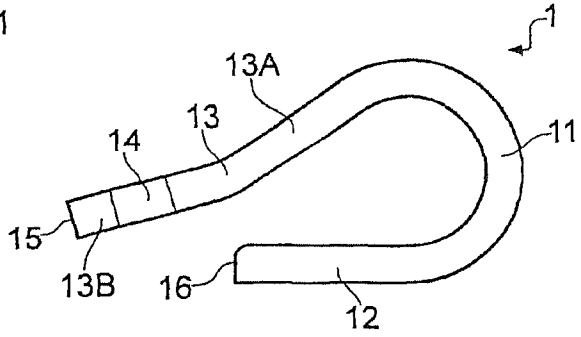
FIGS. 2A, 2B, 2C and 2D show respective perspective, plan, cross-sectional and side views of a railway rail fastening clip embodying the present invention, FIG. 2C showing a cross-section of the clip taken on line C-C in FIG. 2B.
Figure 2A:
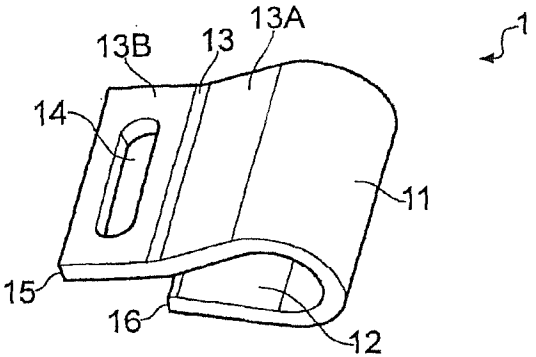
Figure 2B:
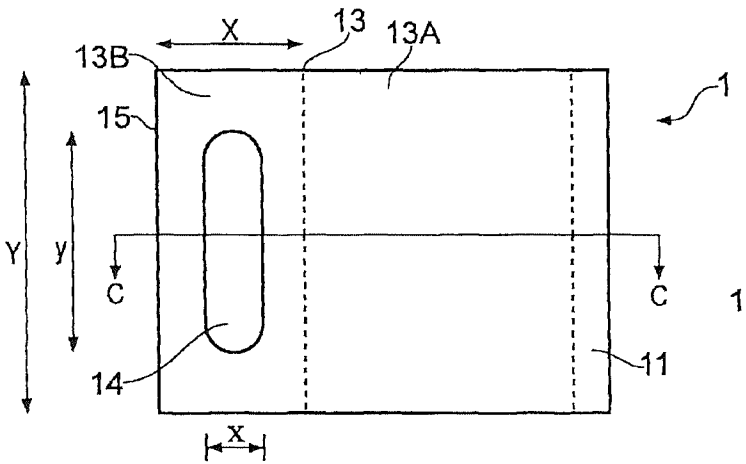
Figure 2D:
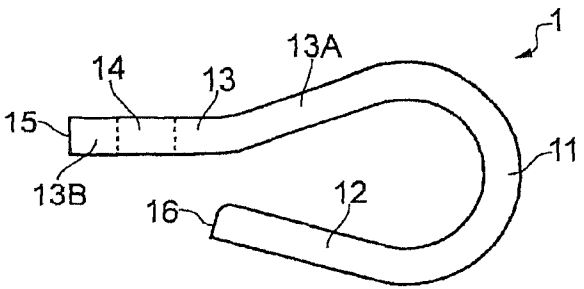

As shown in FIGS. 2A to 2D, a railway rail fastening clip 1 embodying the present invention, for fastening a railway rail to an underlying rail foundation, is formed of an elongate plate shaped such that a central region 11 of the plate, forming the rear arch of the clip 1, has in profile the form of a letter C. A first end region of the plate, extending from one side of the central region 11 of the plate to a free end 16, forms a substantially planar base portion 12 of the clip 1 for engaging a rail fastening anchoring device secured to the rail foundation. A second end region of the plate, extending from the opposite side of the central region 11 of the plate to a free end 15, forms a toe portion 13 of the clip 1 for bearing on the railway rail, such that in profile the second end region extends further than the first end region. The second end region, forming the toe portion 13 of the clip 1, is shaped so as to have first and second main parts, 13A and 13B, and a lower load bearing surface 13C, the first main part 13A extending from the central region 11 in a first direction and the second main part 13B extending from the first main part 13A in a second direction different to the first direction. Branding, identifying the origin of the clip, may be applied to the first main part 13A or the second main part 13B, and in this position it will be visible when the clip is in use.

The toe portion 13 of the clip is provided with a throughhole 14 configured to receive a corresponding portion of a toe insulator (not shown in FIGS. 2A to 2D) for electrically insulating the clip 1 from the rail whereby the insulator can be retained on the toe portion 13 of the clip 1. As shown most clearly in FIG. 2A, the throughhole 14 is not open at the free end 15 of the clip 1. In this embodiment the throughhole 14 comprises an elongate slot, with an approximately rectangular periphery, having substantially straight long sides and rounded short sides, but other shapes of throughhole 14 may be provided. The throughhole 14 is preferably of relatively large area compared to that of the second main part 13B and may be formed, for example, by cold-punching through the toe portion (second end region) of the plate, were the stress is low. For example, if in the clip 3 shown in FIGS. 2A to 2D the dimension X was 31.5 mm and the dimension Y was 77 mm, dimension x of the throughhole 14 would be around 12.7 mm and dimension y of the throughhole 14 would be around 50.8 mm.

As can be seen from the superposed clips 1 and 3 shown in FIG. 3A, in certain embodiments the side-on geometry of the clip 1 differs from the prior art clip 3 described above in various ways, as will now be described with reference to FIG. 3B which shows the clip 1 and FIG. 3C which shows the prior art clip 3 described above. As shown in the Figures, H and H' represent the respective heights of the clips 1, 3 in profile, defined as the maximum extent of the clips 1, 3 above a plane A containing an outer surface of the base portion 13, 33; L, L' represents the length of the clip 1, 3 in profile, defined as the maximum extent of the clip 1, 3 in a direction parallel to the plane A; $\alpha$, $\alpha'$ is the angle made by the first direction, in which the first main part 13A, 33A of the second end region extends, with respect to the plane A; β, β' is the angle made by the second direction, in which the second main part 13B, 33B of the second end region extends, with respect to the plane A; h, h' is the minimum distance between the plane A and a point on the second end region of the clip 1, 3 which is closest to the plane A; and B, B' is the maximum extent of the base portion 12, 32 of the clip 1, 3 from the outermost edge of the central region 11, 31 to the free end of the first end region measured parallel to the plane A.

In a clip 1 embodying the present invention, which is in an unstressed configuration (i.e. before installation of the clip in a rail fastening assembly), an aspect ratio H/L for the clip 1 may be ≤0.6. The aspect ratio H/L may fall within a range from 0.4 to 06, or more preferably from 0.45 to 0.6, or even more preferably from 0.45 to 0.55. Prior art clips 3 have a larger aspect ratio H'/L' than such a clip 1, for example a typical clip 3, such as shown in FIG. 3B, has an aspect ratio H'/L' of 0.64. For the clip 1 shown in FIG. 3A by way of example, H/L is 0.49.

In a clip 1 embodying the present invention, which is in an unstressed configuration (i.e. before installation of the clip in a rail fastening assembly), the angle α made by the first direction with respect to the plane A may be ≤50°. Angle α may fall within a range from 20° to 50°, or more preferably from 30° to 50°, or even more preferably from 30° to 40°. Prior art clips 3 have a larger angle α' than such a clip 1, for example a typical clip 3, such as shown in FIG. 3B, has an angle α' of 68°. For the clip 1 shown in FIG. 3A by way of example, angle α is 35°.

In a clip 1 embodying the present invention, which is in an unstressed configuration (i.e. before installation of the clip in a rail fastening assembly), a ratio H/h for the clip 1 may be ≤6.00. The ratio H/h may fall within a range from 3.00 to 6.00, or more preferably from 4.00 to 6.00, or even more preferably from 4.00 to 5.00. Prior art clips 3 have a larger ratio H'/h' than such a clip 1, for example a typical clip 3, such as shown in FIG. 3B, has a ratio H'/h' of 7.4. For the clip 1 shown in FIG. 3A by way of example, ratio H/h is 4.6.

In such configurations the clip is easier to extract from a shoulder and to install therein than a prior art clip such as the clip 3. For example, the extraction force required to remove a typical clip, such as the example clip 1 shown in FIG. 3A, from a shoulder was found to be 18.95 kN, whereas an extraction force of 37.65 kN was unable to remove the clip 3 from the same shoulder. Similarly, the installation force required to drive a typical clip, such as the example clip 1 shown in FIG. 3A, into the shoulder was found to be 13.55 kN as compared to an installation force of 26.79 kN required to drive the clip 3 into the same shoulder.

Figure 3A:
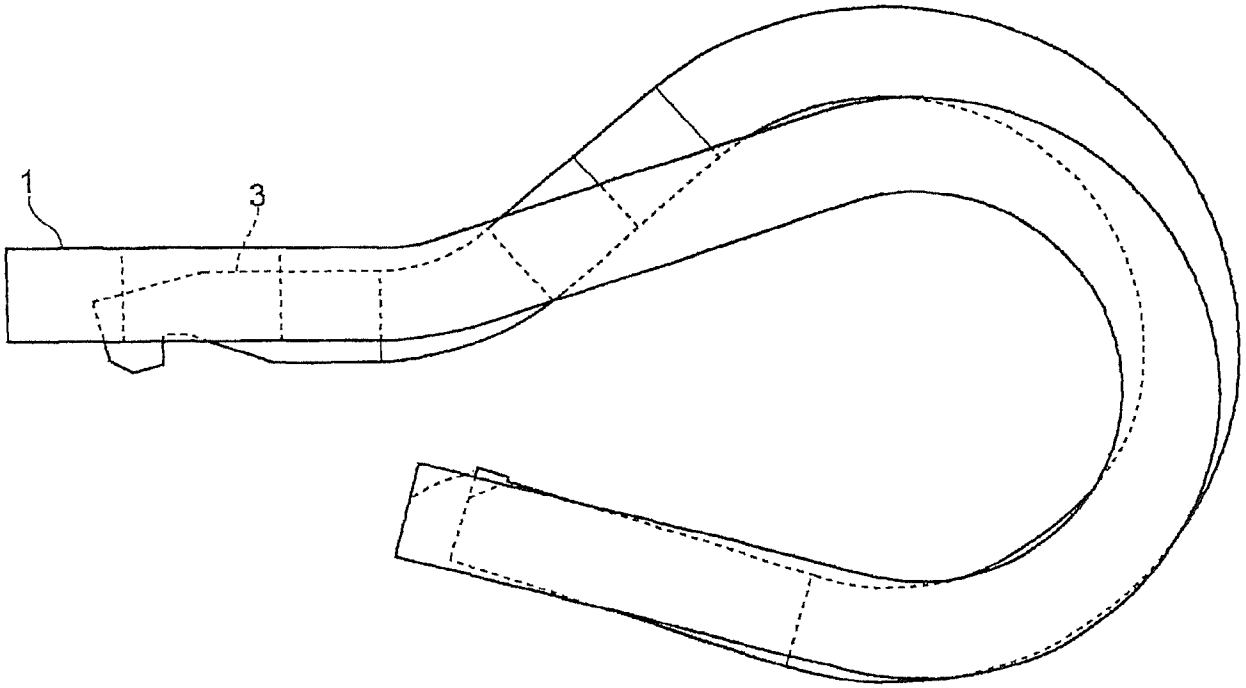
FIG. 3A shows a side view of a rail clip embodying the present invention superposed on a side view of a prior art rail clip.
Figures 3B, 3C:
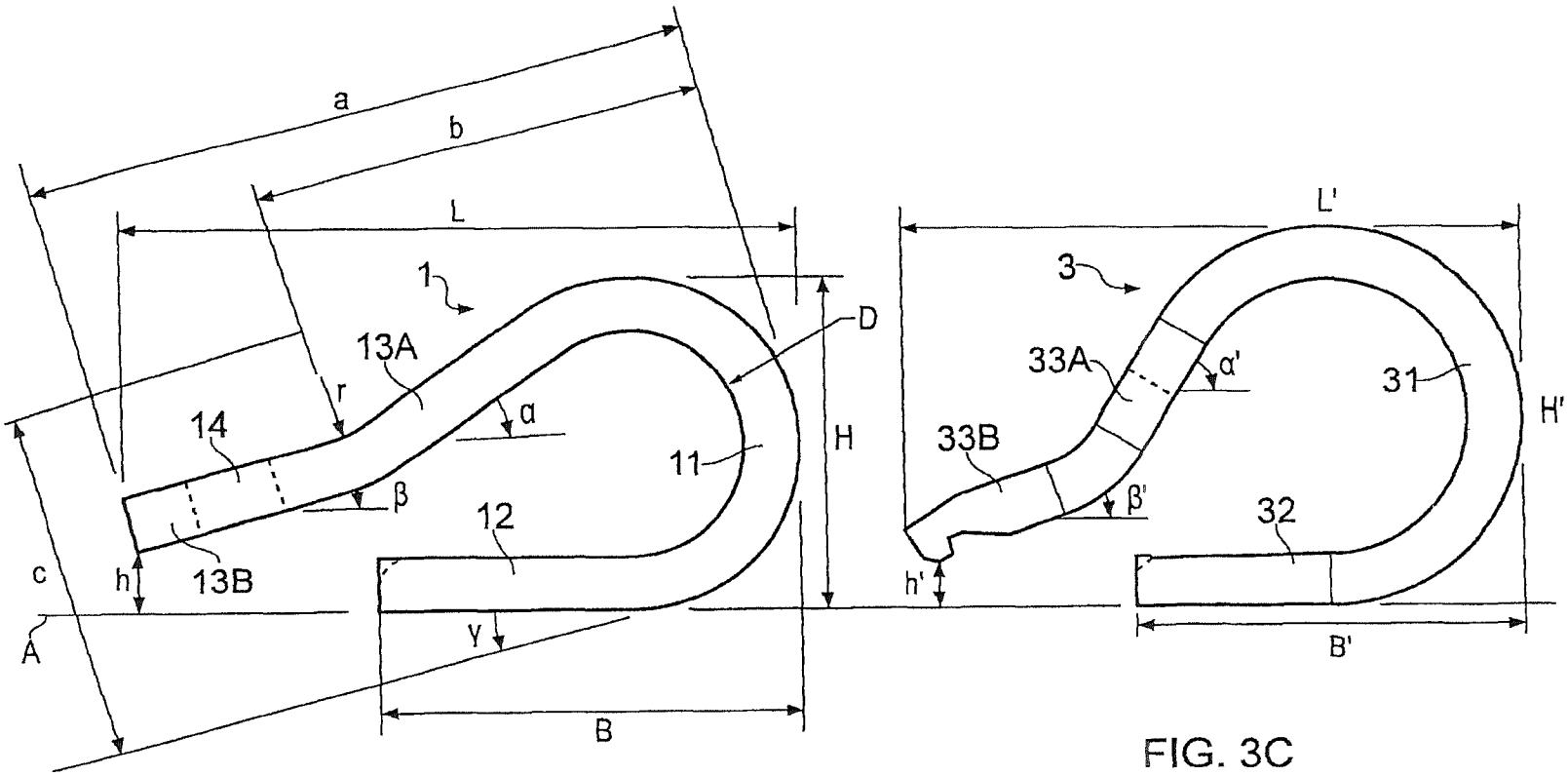
FIG. 3C PRIOR ART
FIGS. 3B and 3C show respective side views of the rail clip embodying the first to fifth aspects of the present invention and the prior art rail clip.

For the clip 1 shown in FIG. 3A by way of example, length B is 61.5 mm and angle β is 14.5°, whereas for the clip 3 shown in FIG. 3B length B' is 59 mm and angle β' is 18.5°.

By way of example, other dimensions shown in FIG. 3A may be as follows: length a=98 mm, length b=67 mm and length c=51 mm; diameter D=33 mm; radius of curvature r=14 mm; and angle γ=15°.

Figure 4A:
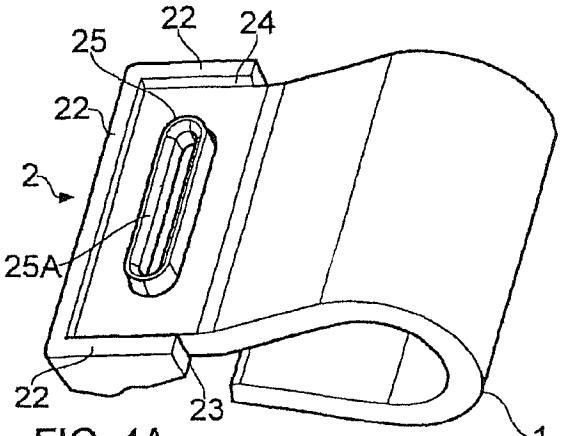
FIGS. 4A and 4B show perspective views of a rail clip embodying the present invention respectively with and without a rail clip insulator.
Figure 4B:
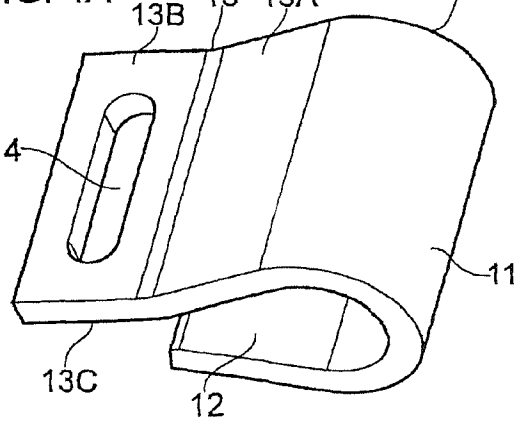
FIG. 4B PRIOR ART
Figure 4C:
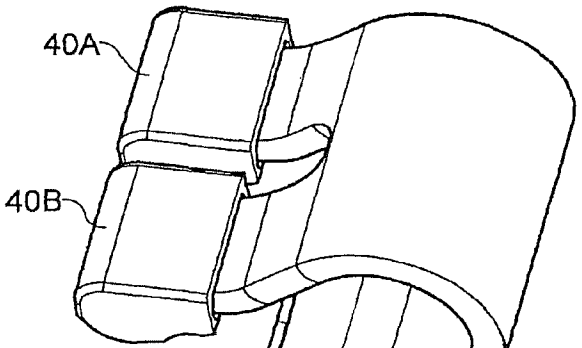
FIGS. 4C and 4D show perspective views of a prior art rail clip respectively with and without rail clip insulators.
Figure 4D:
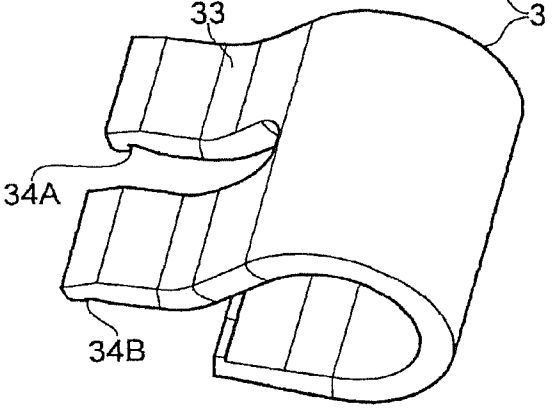
FIG. 4D PRIOR ART
Figure 6A:
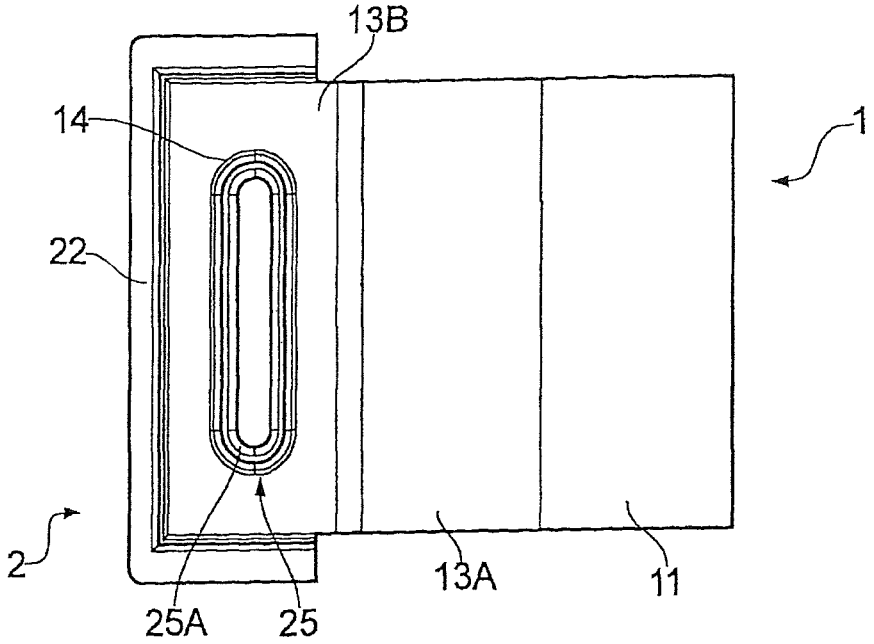
FIGS. 6A and 6B show respective plan and side views of a clip embodying the present invention to which a rail clip insulator is attached.
Figure 6B:
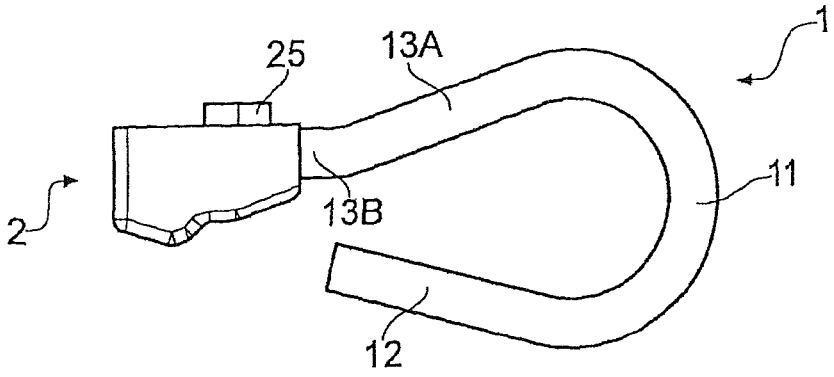
Figure 6C:
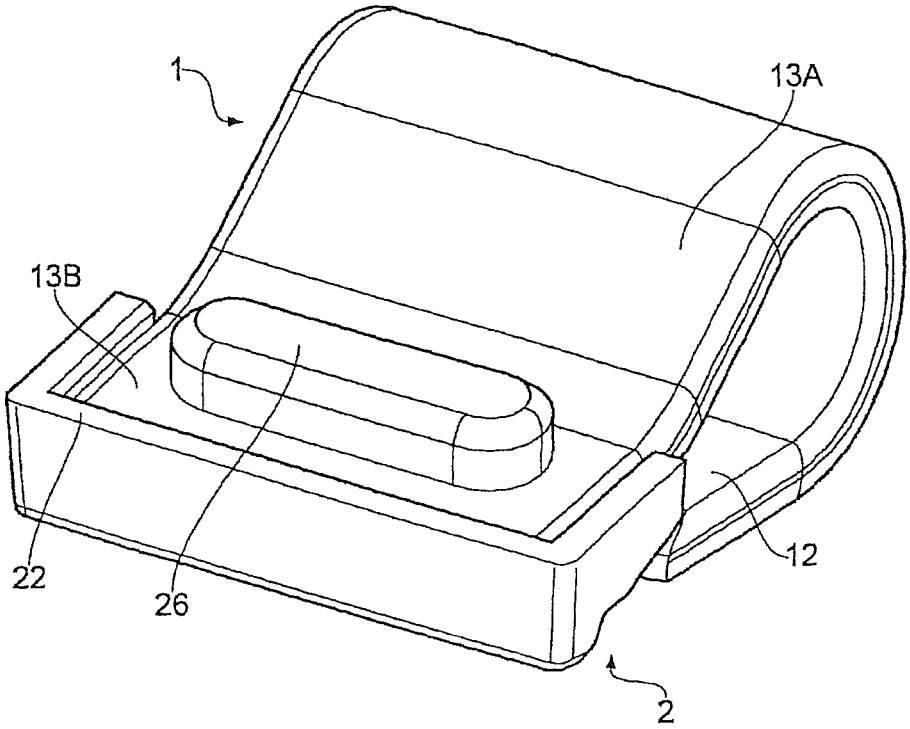
FIG. 6C shows a perspective view of a clip embodying the present invention attached to an alternative rail clip insulator.

As can be seen by comparing the clip 1 shown in FIG. 4B with the clip 3 shown in FIG. 4D, unlike the toe portion 33 of the clip 3, the toe portion 13 of the clip 1 is not bifurcated, nor does it have the same sort of insulator-retaining features 34A, 34B as the clip 3 for retaining toe insulators 40A, 40B as shown in FIG. 4C. Instead the toe portion 13 of the clip 1 is provided, in the second main part 13B, with a throughhole 14 in the form of a slot which, as shown in FIG. 4A, can receive part of a rail clip insulator 2 for electrically insulating a railway rail fastening clip from a railway rail. The insulator 2 is shown in more detail in FIGS. 5A to 5F. Further views of the insulator 2 attached to the toe of the clip 3 are shown in FIGS. 6A and 6B, and FIG. 6C which shows an alternative embodiment.

The insulator 2 comprises a base 21 and walls 22 extending upwards from the base 21 around some of the periphery of the base 21 so as to leave an opening 23 along part of the periphery. The base 21 and the walls 22 together define an open-topped recess 24 for receiving the toe portion 13 of the clip 1, in particular for receiving the second main part 13B. A spigot 25 is located substantially centrally on the base 21 and extends upwards from the base 21 for retaining the toe portion 13 of the clip 1 within the recess 24. The top of the spigot 25 extends above the walls 22. When in use the insulator 2 is arranged on the lower, load bearing surface 13C of the toe portion 13 of the clip 1 such that the spigot 25 of the insulator 2 extends through the said throughhole 14 of the toe portion 13.

Like the throughhole 14, the spigot 25 has an approximately rectangular outline, having substantially straight long sides and rounded short sides. In this embodiment the spigot 25 is made of deformable material and is shaped and sized relative to the throughhole 14 so as to have an interference/mechanical fit therewith which acts to retain the insulator on the toe portion of the clip. In some circumstances, for example to provide a more secure fit on the clip 1 during transportation and/or where the spigot 25 is made of non-deformable material and/or is not shaped and sized so as to have an interference fit with the throughhole 14, a top end of the spigot 25, which extends upwards beyond the throughhole 14, may be adapted to extend over part of an upper surface of the toe portion 13 adjacent to the throughhole 14, such that the spigot 25 cannot pull back through. For example, the top end of the spigot 25 may be shaped during manufacture so as to have a snap-fit design (for example, an outwardly-extending deformable annular lip, not shown), or re-shaped (not shown) after the spigot 25 has been inserted into the throughhole 14 for example by ultrasonic staking). Alternatively, after insertion into the throughhole 14, the top end of the spigot 25 may be fitted (for example, by welding) with a cap member 26, as shown in FIG. 6C, the periphery of which extends beyond the periphery of the throughhole 14.

Although not essential, to save material, and/or to facilitate ultrasonic or other means of assembly, it is desirable if the spigot 25 is a hollow, or partly hollow (as in this embodiment), member, comprising walls 25A defining the outline of the spigot 25, which is open at its top. Although not shown in this example, the spigot may also be open at its bottom. As mentioned above, and shown in FIG. 6C, the open end of the spigot 25 may be covered with a cap member 26.

Figure 7A:
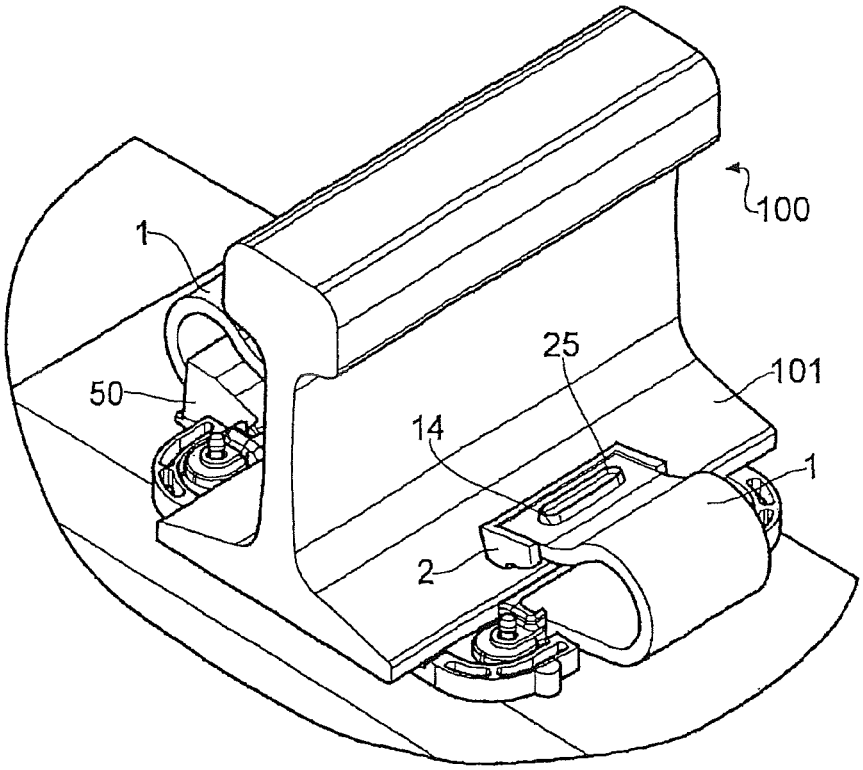
FIGS. 7A to 7D show respective perspective, side, plan and cross-sectional views of a clip embodying the present invention, with attached insulator, in its operative configuration installed in an anchoring device, where
Figure 7B:
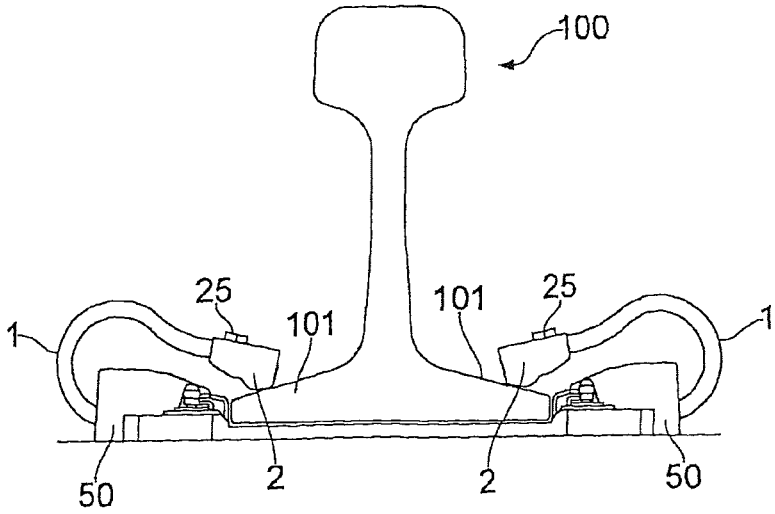
Figure 7C:
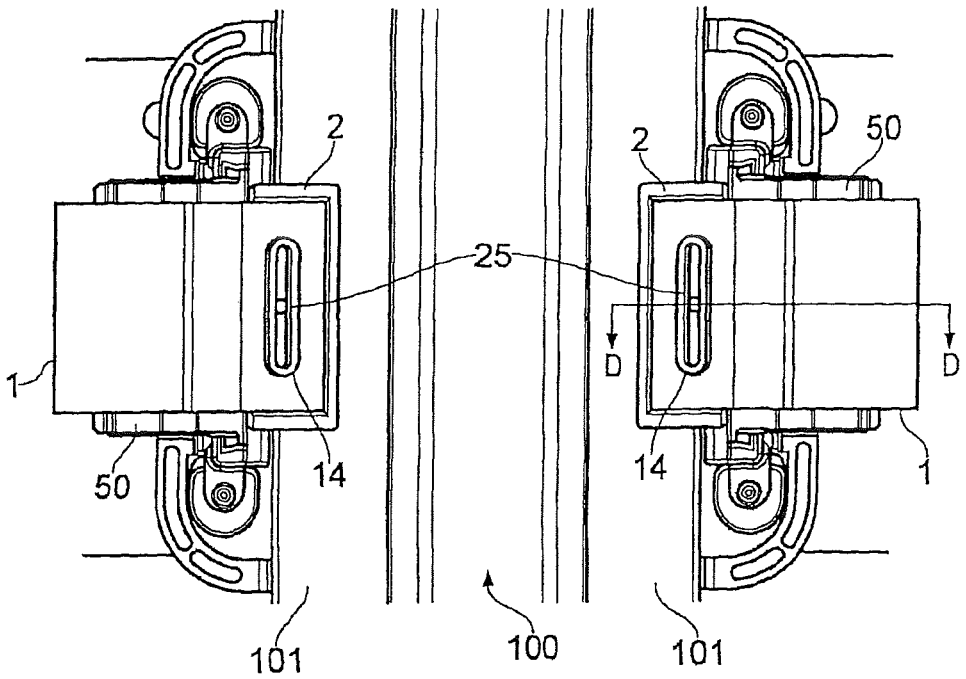
Figure 7D:
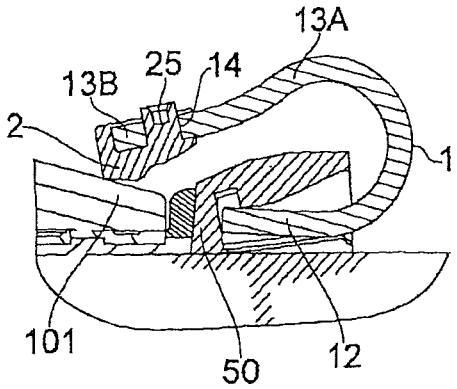

As shown in FIGS. 7A to 70, particularly FIG. 7C, when the clip 1 is in its operative configuration, fully installed in an anchoring device 50 and bearing on a rail 100 such that the insulator 2 is in contact with a foot 101 of the rail, part but not all of the throughhole 14 of the clip 1 lies over the rail foot 101. In particular, whilst part of the periphery 140 of the throughhole 14, when viewed from above the rail 100, extends beyond the outer edge 103 of the rail foot 101, the remaining part of the throughhole periphery 140 extends over the rail foot 101. It should be noted, however, that in some embodiments all parts of the periphery 140 of the throughhole 14 may extend over the rail foot.

The invention claimed is:

1. An apparatus comprising:

a railway rail fastening clip for fastening a railway rail to an underlying rail foundation; and a rail clip insulator for electrically insulating the clip from a railway rail, wherein the railway rail fastening clip is formed of an elongate plate shaped such that a central region of the plate has in profile the form of a letter C, a first end region of the plate extending from one side of the central region of the plate to form a substantially planar base portion of the clip for engaging a rail fastening anchoring device secured to the rail foundation and a second end region of the plate having a free end and extending from the opposite side of the central region of the plate to form a toe portion of the clip for bearing on a foot of the railway rail, such that in profile the second end region extends further than the first end region, wherein the toe portion of the clip is provided with a throughhole which is not open at the free end of the second end region and is arranged such that, when the clip is in its operative configuration, part or all of the throughhole lies above the foot of the rail, the throughhole being configured to receive a corresponding portion of the rail clip insulator, whereby the insulator can be retained on the toe portion of the clip, wherein the rail clip insulator comprises:

a base;

walls extending upwards from the base around some of the periphery of the base so as to leave an opening along part of the periphery, the base and the walls together defining an open-topped recess for receiving the toe portion of the clip; and a spigot extending upwards from the base for retaining the toe portion of the clip within the recess, and wherein the said insulator is arranged on a lower, load bearing surface of the toe portion of the said clip such that the spigot of the insulator extends through the said throughhole of the said toe portion.

2. The apparatus as claimed in claim 1, wherein the throughhole comprises an elongate slot.

3. The apparatus as claimed in claim 2, wherein the slot has an approximately rectangular periphery, having substantially straight long sides and rounded short sides.

4. The apparatus as claimed in claim 1, wherein an aspect ratio H/L for the clip is ≤0.6, H being the height of the clip in profile defined as the maximum extent of the clip above a plane containing an outer surface of the base portion and L being the length of the clip in profile defined as the maximum extent of the clip in a direction parallel to the plane.

5. The apparatus as claimed in claim 1, wherein a ratio H/h for the clip is ≤6.00, H being the maximum extent of the clip above a plane containing an outer surface of the base portion and h being the minimum distance between the plane and a point on the second end region of the clip which is closest to the plane.

6. The apparatus as claimed in claim 1, wherein the spigot is made of deformable material.

7. The apparatus as claimed in claim 1, wherein the spigot is a hollow member.

8. The apparatus as claimed in claim 7, wherein the spigot is open at its top and/or its bottom.

9. The apparatus as claimed in claim 1, wherein the spigot comprises spigot walls defining the outline of the spigot.

10. The apparatus as claimed in claim 9, wherein the spigot is open at its top and/or its bottom.

11. The apparatus as claimed in claim 1, wherein the spigot is located substantially centrally on the base.

12. The apparatus as claimed in claim 1, wherein the spigot has an approximately rectangular outline, having substantially straight long sides and rounded short sides.

13. The apparatus as claimed in claim 1, wherein a top end of the spigot, which extends upwards beyond the throughhole, is shaped such that it extends over part of an upper surface of the toe portion adjacent to the throughhole.

14. A clip and insulator combination as claimed in claim 1, wherein a top end of the spigot, which extends upwards beyond the throughhole, is provided with a cap member which extends over part of an upper surface of the toe portion adjacent to the throughhole.

15. A railway fastening clip in combination with a rail clip insulator, wherein the clip is for fastening a railway rail to an underlying rail foundation, which clip is formed of an elongate plate shaped such that a central region of the plate has in profile the form of a letter C, a first end region of the plate extending from one side of the central region of the plate to form a substantially planar base portion of the clip for engaging a rail fastening anchoring device secured to the rail foundation and a second end region of the plate extending from the opposite side of the central region of the plate to form a toe portion of the clip for bearing on a foot of the railway rail, such that in profile the second end region extends further than the first end region, wherein the toe portion of the clip is provided with a throughhole which is arranged such that, when the clip is in its operative configuration, part or all of the throughhole lies above the foot of the rail, the throughhole being configured to receive a corresponding portion of a toe insulator for electrically insulating the clip from the rail whereby the insulator can be retained on the toe portion of the clip, and wherein the insulator is for electrically insulating the clip from the railway rail, the insulator comprising: a base; walls extending upwards from the base around some of the periphery of the base so as to leave an opening along part of the periphery, the base and the walls together defining an open-topped recess for receiving the toe portion of the clip; and a spigot extending upwards from the base for retaining the toe portion of the clip within the recess, wherein the said insulator is arranged on a lower, load bearing surface of the toe portion of the said clip such that the spigot of the insulator extends through the said throughhole of the said toe portion.

16. A clip and insulator combination as claimed in claim 15, wherein the spigot is made of deformable material.

17. A clip and insulator combination as claimed in claim 15, wherein the spigot is a hollow member.

18. A clip and insulator combination as claimed in claim 17, wherein the spigot is open at its top and/or its bottom.

19. A clip and insulator combination as claimed in claim 15, wherein the spigot comprises spigot walls defining the outline of the spigot.

20. A clip and insulator combination as claimed in claim 19, wherein the spigot is open at its top and/or its bottom.

21. A clip and insulator combination as claimed in claim 15, wherein the spigot is located substantially centrally on the base.

22. A clip and insulator combination as claimed in claim 15 wherein the spigot has an approximately rectangular outline, having substantially straight long sides and rounded short sides.

23. A clip and insulator combination as claimed in claim 15, wherein a top end of the spigot, which extends upwards beyond the throughhole, is shaped such that it extends over part of an upper surface of the toe portion adjacent to the throughhole.

24. A clip and insulator combination as claimed in claim 15, wherein a top end of the spigot, which extends upwards beyond the throughhole, is provided with a cap member which extends over part of an upper surface of the toe portion adjacent to the throughhole.

* * * * *